US011377876B2

(12) United States Patent
Levavi et al.

(10) Patent No.: US 11,377,876 B2
(45) Date of Patent: Jul. 5, 2022

(54) MAGNETIC KEEPER FOR BICYCLE LOCK ELEMENT

(71) Applicant: Ino Vision Ltd., Herzliya (IL)

(72) Inventors: Shahaf Levavi, Tel Aviv (IL); Michael Shenkerman, Rishpon (IL)

(73) Assignee: Ino Vision Ltd., Herzliya (IL)

( * ) Notice: Subject to any disclaimer, the term of this patent is extended or adjusted under 35 U.S.C. 154(b) by 381 days.

(21) Appl. No.: 16/740,639

(22) Filed: Jan. 13, 2020

(65) Prior Publication Data

US 2020/0240173 A1 Jul. 30, 2020

Related U.S. Application Data

(60) Provisional application No. 62/797,432, filed on Jan. 28, 2019.

(51) Int. Cl.

| | |
|---|---|
| ***E05B 47/00*** | (2006.01) |
| ***E05B 67/00*** | (2006.01) |
| ***E05B 67/06*** | (2006.01) |
| ***E05B 73/00*** | (2006.01) |
| ***E05B 71/00*** | (2006.01) |

(52) U.S. Cl.

CPC ..... *E05B 47/004* (2013.01); *E05B 67/003* (2013.01); *E05B 67/06* (2013.01); *E05B 73/0005* (2013.01)

(58) Field of Classification Search

CPC ..... Y10T 70/7057; Y10T 70/7904; Y10T 292/11; E05B 47/004; E05B 67/003; E05B 67/06; E05B 73/0005; E05B 67/063; E05B 47/0038; E05B 71/00

See application file for complete search history.

(56) References Cited

U.S. PATENT DOCUMENTS

| | | | | |
|---|---|---|---|---|
| 241,279 | A * | 5/1881 | Barth | |
| 1,792,403 | A * | 2/1931 | Stone | E05B 67/003 70/38 R |
| 8,881,559 | B1 * | 11/2014 | Chang | E05B 67/003 70/53 |
| 8,904,833 | B1 * | 12/2014 | Liu | E05B 9/084 70/38 C |
| 2005/0061038 | A1 * | 3/2005 | Ling | E05B 67/063 70/30 |
| 2011/0219829 | A1 * | 9/2011 | Trunek | E05B 67/003 70/58 |
| 2018/0258668 | A1 * | 9/2018 | Buseman | E05B 71/00 |
| 2019/0218827 | A1 * | 7/2019 | Kindstrand | E05B 67/063 |

* cited by examiner

*Primary Examiner* — Lloyd A Gall
(74) *Attorney, Agent, or Firm* — Dekel Patent Ltd.; David Klein

(57) ABSTRACT

A lock assembly includes a lock element, and a lock housing including a receptacle for receiving therein the lock element. The lock housing includes a lock device that in a locked configuration is in locking engagement with the lock element and in an unlocked configuration is not in locking engagement with the lock element. A magnetic member magnetically holds the lock element in the receptacle against a force of gravity in the unlocked configuration.

6 Claims, 2 Drawing Sheets

MAGNETIC KEEPER FOR BICYCLE LOCK ELEMENT

FIELD OF THE INVENTION

The present invention relates generally to locks that use linking elements, such as chains or cables, and particularly to a combination chain and cable lock, which may be used for bicycles and other items.

BACKGROUND OF THE INVENTION

There are many types of utility locks and/or locking devices used for securing objects such as bicycles, to poles, stands and the like. Known devices include U-shaped locks, cable, chain, padlock and folding link member lock devices. Other known locking devices which use various other encircling components as means for securing objects such as a bicycle and aimed at theft prevention, include cuff locks, as well as hinged locks that are circular, oval, and square relatives to the U-lock.

In all of the known prior art bicycle locks, some lock element, such as one of the links of a chain lock, or one of the folding link members of a folding lock or the shackle of a U-lock or padlock, etc., is inserted into a receptacle of the bicycle lock. This lock element must be held by the user until the lock is brought into locking engagement with the lock element; otherwise, if not held by the user, the lock element can fall out of the receptacle.

SUMMARY OF THE INVENTION

The present invention seeks to provide an improved locking device, which may be used for bicycles and other items, such as but not limited to, strollers, carriages and the like, as is described in detail further hereinbelow. The term "bicycle lock" is used to encompass a lock for bicycles and these other items.

In the present invention, unlike the prior art, the element does not have to be held by the user until the lock is brought into locking engagement with the lock element; instead, a magnet holds the lock element in place and the lock element cannot fall out of the receptacle in the unlocked configuration. The magnet is strong enough to hold the lock element in place against the force of gravity, yet the magnet is weak enough to permit the user to grasp the lock element and pull the lock element out of the receptacle.

Thus, the present invention eliminates any aggravating situation in which the user has to struggle keeping the lock element in place with one hand and lock the device with the other hand.

There is thus provided in accordance with an embodiment of the present invention a lock assembly including a lock element, a lock housing including a receptacle for receiving therein the lock element, the lock housing including a lock device that in a locked configuration is in locking engagement with the lock element and in an unlocked configuration is not in locking engagement with the lock element, and a magnetic member that magnetically holds the lock element in the receptacle against a force of gravity in the unlocked configuration.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1A:
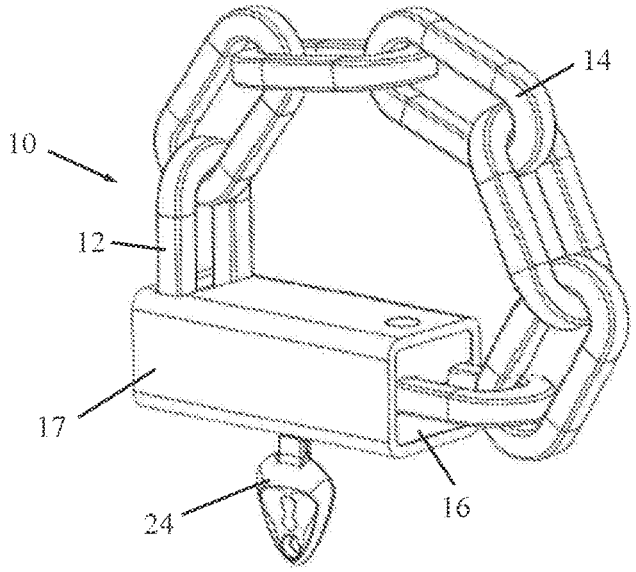
FIG. 1A is a simplified pictorial illustration of a lock assembly, constructed and operative in accordance with a non-limiting embodiment of the present invention, the lock assembly being a chain lock.
Figure 1B:
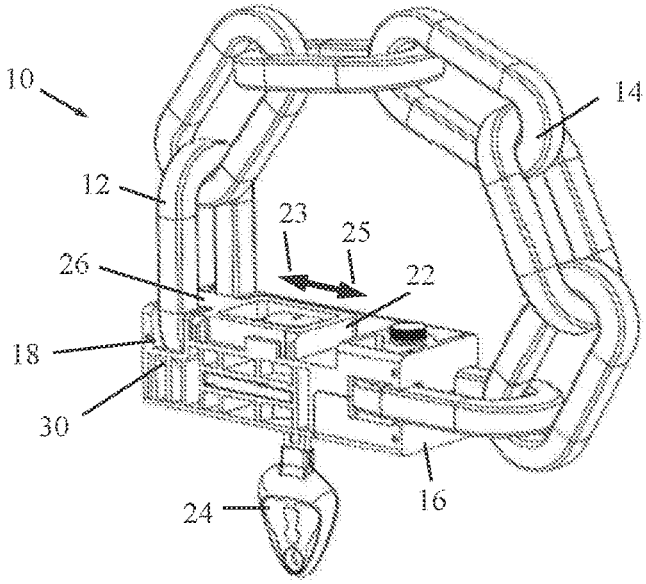
FIG. 1B is a simplified pictorial illustration of the lock assembly, with the lock housing case removed to reveal the components of the lock device.
Figure 1C:
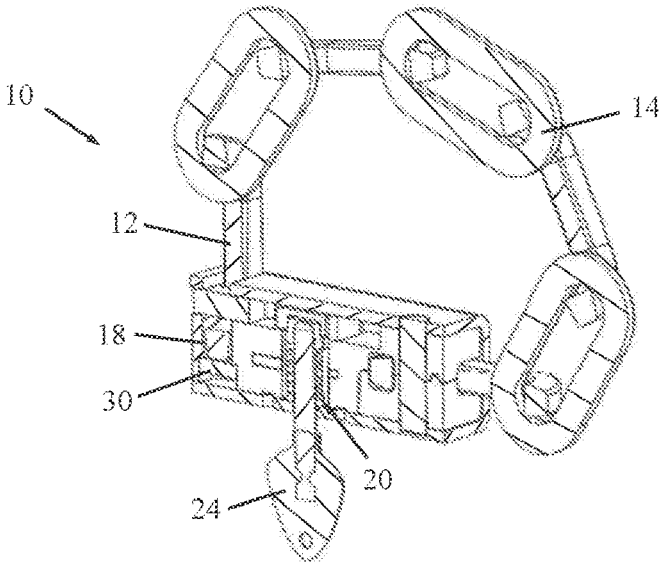
FIG. 1C is a simplified sectional illustration of the lock assembly of FIG. 1B.

Reference is now made to FIGS. 1A-1C, which illustrates lock assembly 10, constructed and operative in accordance with a non-limiting embodiment of the present invention. Here the lock assembly is a chain lock, but the invention is not limited to this type of lock.

The lock assembly 10 includes a lock element 12, which in this case, is a link of a chain 14. The lock assembly 10 includes a lock housing 16 that has a receptacle 18 for receiving therein lock element 12. (As seen in FIG. 1A, lock housing 16 may include an outer casing 17 made of a strong steel alloy and the like, to prevent tampering by vandals.) Lock housing 16 includes a lock device 20 (FIG. 1C) that in a locked configuration is in locking engagement with lock element 12 and in an unlocked configuration is not in locking engagement with lock element 12.

Lock device 20 may be a cylinder lock operated by a key 24 or any other type of lock, such as but not limited to, a combination lock, cylinder lock, wafer lock, or wireless communication lock (that operates with a transponder that communicates with identification circuitry in the lock to gain authorized access to the lock), e.g., an RFID lock, NFC lock, Bluetooth lock, Wi-Fi lock, mobile device, and others. Other locking types can also be used.

For example, lock device 20 may include a cam or other locking member 22 which can be moved linearly by turning key 24 in the lock device 20. Locking member 22 includes a tongue 26, which in the locked configuration is moved over lock element 12 (in the direction of an arrow 23 in FIG. 1B) so as to prevent lock element 12 from being pulled out of receptacle 18. In the unlocked configuration, tongue 26 is moved away from lock element 12 (in the direction of an arrow 25 in FIG. 1B) so as to permit lock element 12 to be pulled out of receptacle 18.

In accordance with a non-limiting embodiment of the present invention, lock assembly 10 includes a magnetic member 30 that magnetically holds lock element 12 in receptacle 18 against a force of gravity in the unlocked configuration. The magnetic member 30 is strong enough to hold lock element 12 in place in receptacle 18 against the force of gravity, yet magnetic member 30 is weak enough to permit the user to grasp lock element 12 and pull lock element 12 out of receptacle 18. The magnetic member 30 may be made of neodymium-iron-boron or other magnetic materials.

The magnetic member 30 is useful not only for holding lock element 12 in place in receptacle 18 against the force of gravity; it also ensures that lock element 12 is properly seated in receptacle 18 so that lock element 12 is not misaligned with the locking mechanism of lock device 20.

Figure 2A:
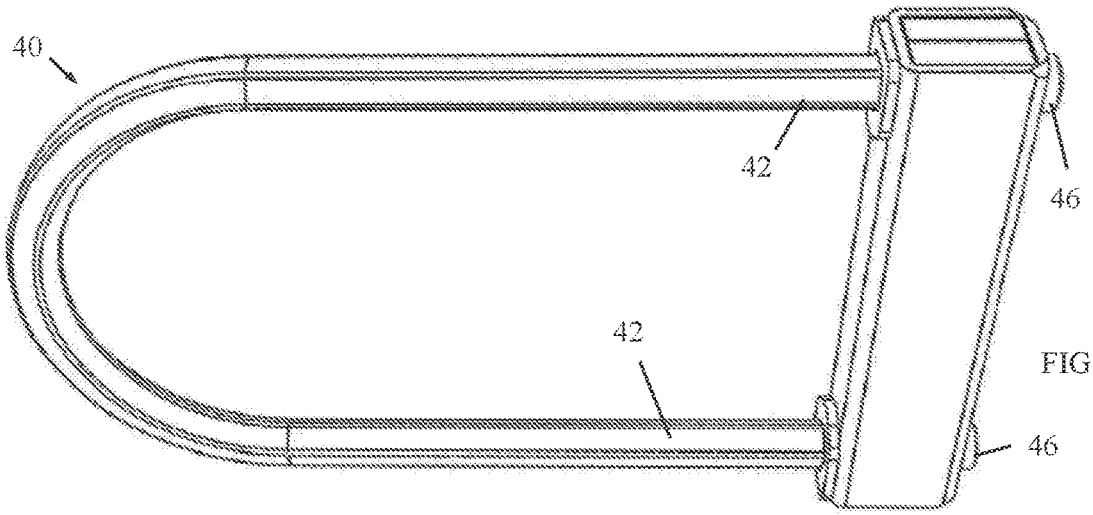
FIG. 2A is a simplified pictorial illustration of a lock assembly, constructed and operative in accordance with another non-limiting embodiment of the present invention, the lock assembly being a U-lock.
Figure 2B:
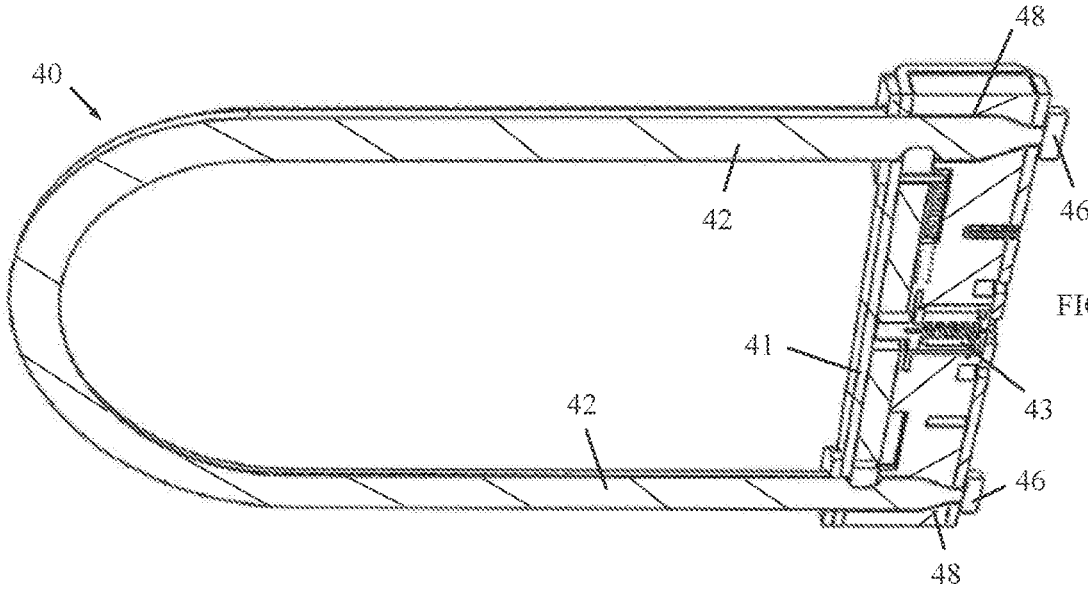
FIG. 2B is a simplified sectional illustration of the lock assembly of FIG. 2A.

Reference is now made to FIGS. 2A-2B, which illustrate a lock assembly 40, constructed and operative in accordance with another non-limiting embodiment of the present invention. In this embodiment, the lock assembly 40 is a U-lock with a U-shackle 42 which is also referred to as lock element 42. Once again, there is a lock housing 41 that includes a receptacle 48 for receiving therein the lock element 42. The lock housing 41 includes a key-operated lock device 43 that in a locked configuration is in locking engagement with the lock element 42 and in an unlocked configuration is not in locking engagement with the lock element 42. A magnetic member 46 magnetically holds the lock element 42 in the receptacle 48 against a force of gravity in the unlocked configuration.

Figure 3:
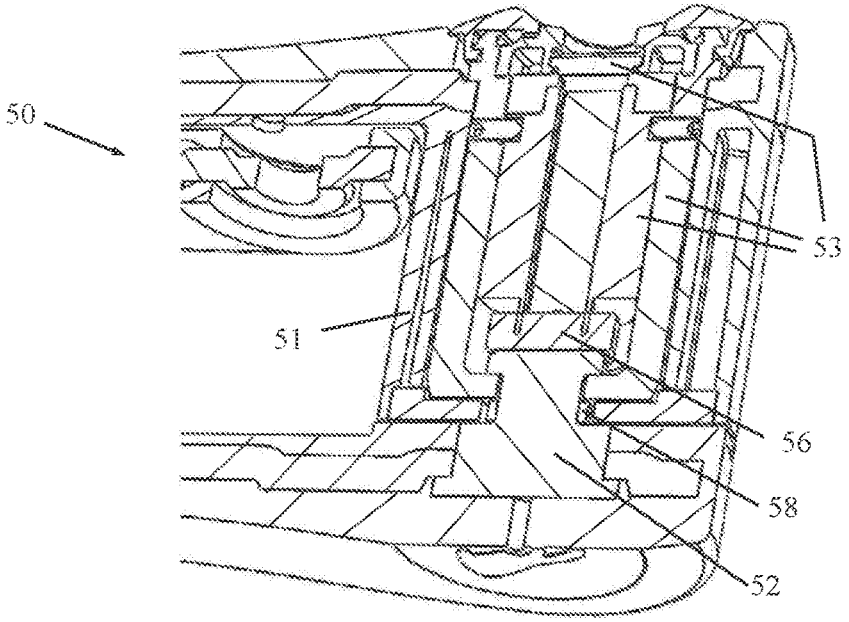
FIG. 3 is a simplified sectional illustration of a lock assembly, constructed and operative in accordance with another non-limiting embodiment of the present invention, the lock assembly being a folding lock.

Reference is now made to FIG. 3, which illustrates a lock assembly 50, constructed and operative in accordance with another non-limiting embodiment of the present invention. In this embodiment, the lock assembly 50 is a folding lock with a link member 52, which is also referred to as lock element 52. Once again, there is a lock housing 51 that includes a receptacle 58 for receiving therein the lock element 52. The lock housing 51 includes a lock device 53 that in a locked configuration is in locking engagement with the lock element 52 and in an unlocked configuration is not in locking engagement with the lock element 52. A magnetic member 56 magnetically holds the lock element 52 in the receptacle 58 against a force of gravity in the unlocked configuration.

What is claimed is:

1. A lock assembly comprising:

a lock element;

a lock housing comprising a receptacle for receiving therein said lock element, said lock housing comprising a lock device that in a locked configuration is in locking engagement with said lock element and in an unlocked configuration is not in locking engagement with said lock element; and a magnetic member that magnetically holds said lock element in said receptacle against a force of gravity in the unlocked configuration.

2. The lock assembly according to claim 1, wherein said magnetic member is strong enough to hold said lock element in place in said receptacle against the force of gravity, yet said magnetic member is weak enough to permit a user to grasp said lock element and pull said lock element out of said receptacle.

3. The lock assembly according to claim 1, wherein said magnetic member ensures that said lock element is properly seated in said receptacle and that said lock element is not misaligned with a locking mechanism of said lock device.

4. The lock assembly according to claim 1, wherein said lock element is part of a chain lock.

5. The lock assembly according to claim 1, wherein said lock element is part of a U-lock.

6. The lock assembly according to claim 1, wherein said lock element is part of a folding lock.

* * * * *